United States Patent [19]

Schellas

[11] Patent Number: 4,785,488

[45] Date of Patent: Nov. 22, 1988

[54] LEVER BAR ADAPTED FOR PERFORMING MULTIPLE FUNCTIONS

[75] Inventor: Arthur Schellas, Baldwin, N.Y.

[73] Assignee: Palbar, Inc., Baldwin, N.Y.

[21] Appl. No.: 128,683

[22] Filed: Dec. 4, 1987

[51] Int. Cl.[4] ..... B66F 15/00

[52] U.S. Cl. ..... 7/166; 7/146; 254/26 R

[58] Field of Search ..... 7/146, 147, 166, 169; 254/25, 26 R, 120, 131

[56] References Cited

U.S. PATENT DOCUMENTS

| | | | |
|---|---|---|---|
| 859,796 | 7/1907 | Bacon | 7/146 |
| 1,551,228 | 8/1925 | White | 254/26 R X |
| 2,860,408 | 11/1958 | Woyton | 7/166 X |
| 3,602,969 | 9/1971 | Provost | 254/131 X |
| 3,710,407 | 1/1973 | Reid | 7/166 X |
| 3,893,200 | 7/1975 | Wanciak | 7/166 |
| 4,597,123 | 7/1986 | Cobe, Jr. | 7/166 X |

*Primary Examiner*—James G. Smith

*Attorney, Agent, or Firm*—Edward H. Loveman

[57] ABSTRACT

An improved, versatile, lever bar which may be used as a crowbar, prybar, sledge hammer, pickaxe, wedge, etc. The lever bar has a long handle with a thick base plate chamfered at one end and secured perpendicular to the axis of the handle at one end thereof. A thick foot plate has a sharp end from which diverge edges defining an acute angle for entering under or behind boards to be pried. A massive, flat, triangular or trapezoidal anvil plate is secured to the base plate and handle. The base plate and anvil plate can serve as hammer heads while the tool is used as sledge hammer. The base plate and foot plate can serve as splitting wedges and as heads of a pickaxe.

13 Claims, 2 Drawing Sheets

LEVER BAR ADAPTED FOR PERFORMING MULTIPLE FUNCTIONS

BACKGROUND OF THE INVENTION

1. Field of the Invention.

This invention relates to the art of lever bars used as crowbars, pinch bars, pry bar, timber bars, and the like; and more particularly concerns a lever bar adapted to perform multiple functions of prying, hammering, wedging, etc.

2. Description of the Prior Art.

The conventional crowbar used for prying has a long, rigid steel bar with a short flattened point at one end which may be bent at an angle to the bar. Such a crowbar is generally used in the construction trades. It has been found that it has serious deficiencies when it is used for prying up floor boards nailed to rafters, shingles nailed to roofs, wall boards nailed to studs, etc. Firstly, the short, bent end does not fit far enough under the part to be lifted or pried to provide a good mechanical grip and good leverage. Secondly, the mechanical advantage of the long handle bar cannot be used effectively because it is at too obtuse an angle to the bent end, so this end of the bar engaged at the part being pried up or out must be struck with a sledge hammer or mallet to assist the crowbar in completing the prying operation. When the bar is struck with a hammer, the boards or parts being pried, often split.

SUMMARY OF THE INVENTION

It is a principal object of the present invention to overcome the difficulties and disadvantages encountered with prior crowbars and other lever bars in performing prying functions. A further object is to provide a versatile lever bar which may perform other useful functions than prying, such as hammering and wedging.

According to the invention there is provided a tool in the form of a lever bar having a long, rigid handle. At one end of the handle is joined a flat rectangular base plate having a chamfered edge for use in prying and hammering. A flat foot with a long, acute angled toe is attached at its wider end axially to the handle adjacent the base plate, which is disposed in a plane perpendicular to the axis of the long handle and to the plane of the foot. The foot serves to pry floor and wall boards without requiring assistance of another hammering tool. A triangular anvil plate is secured to the base plate and is tangential to the handle bar to reinforce the joint. The tool may be used as sledge hammer with the anvil plate or base plate serving as a hammer head. The tool may also be used as a wood beam or a brick splitter, with the chamfered ends at the foot or base serving as a splitting wedge.

These and other objects and many of the attendant advantages of the invention will be readily appreciated as the same becomes better understood by reference to the following detailed description when considered in connection with the accompanying drawings in which:

DESCRIPTION OF THE PREFERRED EMBODIMENTS

Figure 1:
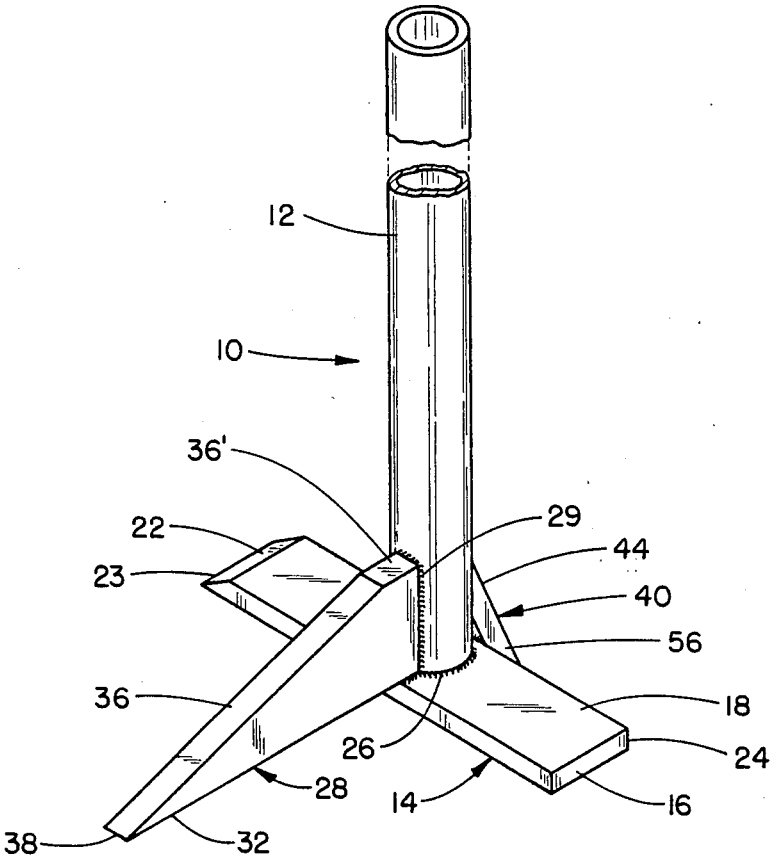
FIG. 1 is an isometric view of a lever bar embodying the invention, part of its handle being omitted.
Figure 2:
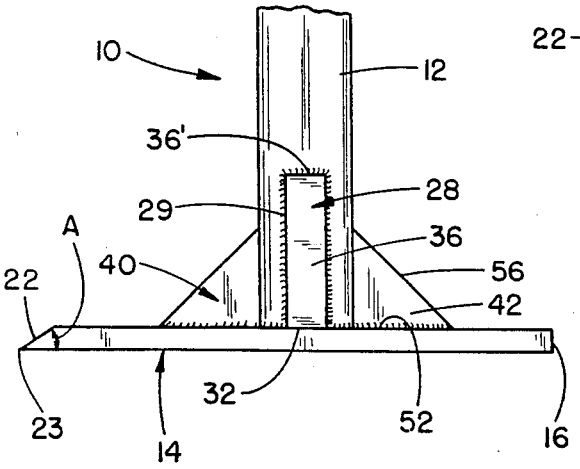
FIG. 2 is a front elevational view of the lever bar part of the handle being omitted.
Figure 3:
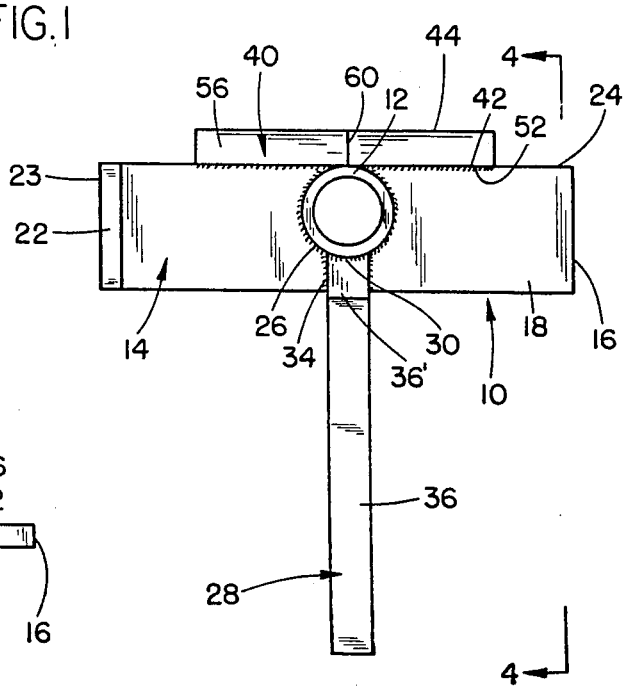
FIG. 3 is a top plan view of the lever bar.
Figure 4:
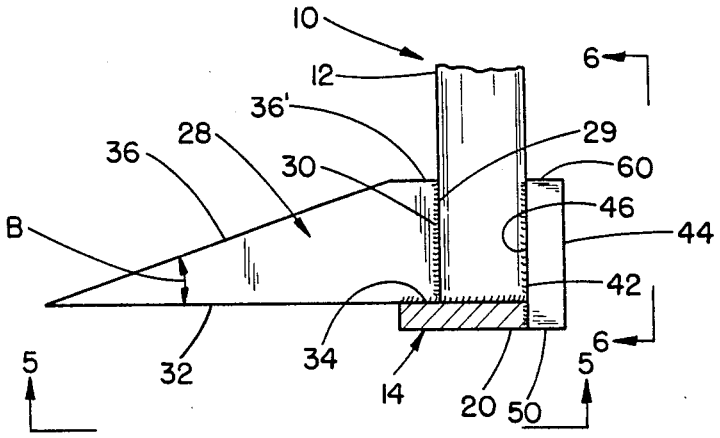
FIG. 4 is a vertical cross sectional view taken along line 4—4 of FIG. 3, part of the handle being omitted.
Figure 5:
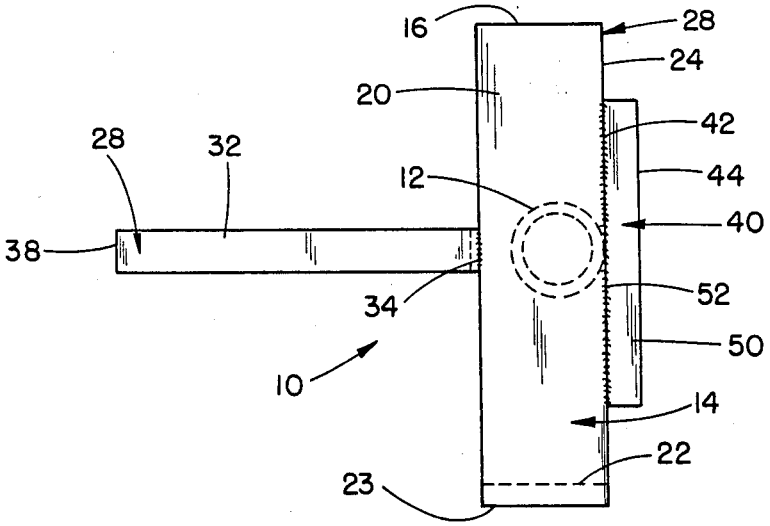
FIG. 5 is a bottom plan view of the lever bar taken along line 5—5 of FIG. 4.

Referring now to the drawings wherein like reference characters designate like or corresponding parts throughout, there is illustrated in FIGS. 1-6, a tool which is a lever bar assembly generally designated by the roman numeral 10. The tool 10 has a relatively long rigid shaft 12 which may be a rigid steel tube. Alternatively the shaft 12 may be a solid bar. The shaft 12 serves as a handle for the tool 10. Secured to one end of the shaft 12 is a rigid rectangular base plate 14 which is disposed in a plane perpendicular to the central axis of the shaft 12. One end or edge 16 of the plate 14 is perpendicular to top and bottom sides 18, 20. The other end or edge 22 is chamfered or beveled inwardly toward the shaft 12 from the longer bottom side 20 to the shorter upper side 18, to define a sharp edge 23. The shaft 12 is centrally located on the upper side 18 adjacent a rear edge 24 of the plate 14. The shaft 12 and the base plate 14 are rigidly secured together by welding 26 encircling the shaft at the side 18 on the plate 14 as clearly shown in FIG. 3. The base plate 14 has two parallel sides 18, 20, and two nonparallel edges 16, 22 so that the plate is trapezoidal in shape when viewed edgewise, as clearly shown in FIG. 2.

A foot plate 28 is rigidly secured by a welding 29 at a rear edge 30 of the shaft 12. The plate 28 is disposed in a diametral plane of the shaft 12. A long bottom edge 32 of the foot plate 28 is rigidly secured near its rear end by a welding 34 to the base plate 14; see FIGS. 3, 4. The foot plate 28 is formed with a long beveled upper edge 36 defining with the bottom edge 32 a wedge shaped toe terminating in a sharp end edge 38. The slanted upper edge 36 terminates short of the shaft 12 at the outer end of a short, top edge 36' which is parallel to the bottom edge 32. Since the foot plate has two parallel edges 32 and 36' and nonparallel edges 30, 36 it is trapezoidal in side elevational view as clearly shown in FIG. 4.

Figure 6:
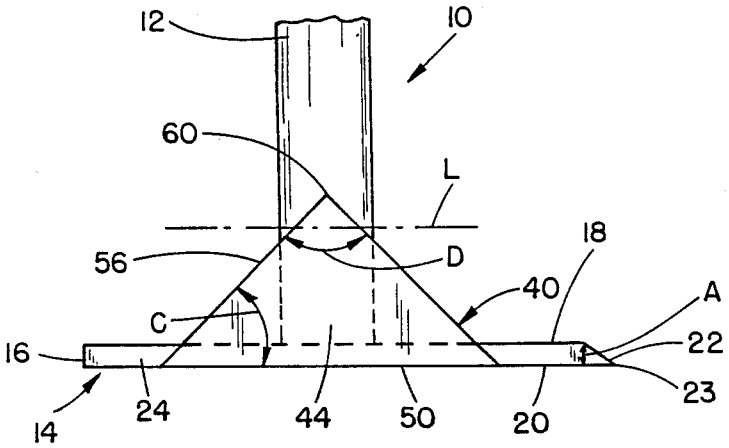
FIG. 6 is a rear elevational view taken along line 6—6 of FIG. 4, part of the handle being omitted.
Figure 7:
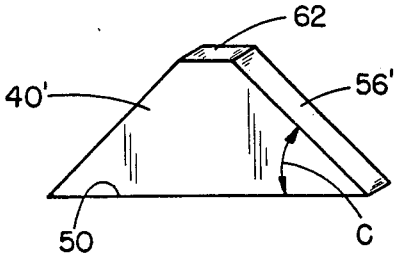
FIG. 7 is an oblique view of an alternate form of an anvil plate.

A massive anvil plate 40 is attached to the rear of the tool 10. The plate 40 has parallel right triangular front and rear sides 42, 44. The plate 40 is rigidly secured by a welding 46 to its shaft 12 in a plane parallel to the central axis of the shaft 12. An apical angle D of plate 40 is uppermost. A flat bottom edge 50 is flush with the bottom side 20 of the plate 14. The plate 40 is further secured by a welding 52 to the rear edge 24 of the plate 14. The plate 42 has two 45 degree base angles C defined by the bottom edge 50 and two inclined edges 56 which define a 90 degree angle D at the apical end 60 of the plate 14. If desired an upper apical end 60 may be cut off on a line L as indicated in FIG. 6 to form a trapezoidal shaped anvil plate 40' shown in FIG. 7. A smaller apical top face 62 is parallel to the flat, rectangular bottom edge 50. The side edges 56' are inclined at an angle of 90 degree to each other.

In an exemplary form of the tool 10, the shaft 12 may be about three feet long, 1.3 inches in external diameters, and one inch in inside diameter. The plates 14, 28 and 40 may be respectively approximately $\frac{3}{8}$, $\frac{5}{8}$ and $\frac{1}{2}$ inches thick. The base plate 24 may be about 8.25 inches long at the bottom side 20. Angle A may be about 35 degrees at the end 23. The width of the plate 14 may be about two inches. The plate 28 may be about 6.125 inches long at the bottom edge 32 which defines an angle B of about 18 degree with the upper slanted edge 36, at the outer end of the plate 28. The slanted edge 36 may be about 5.75 inches long and the top edge 36' may be about 0.75 inches in length. The plate 40 may be about four inches long at the base edge 50. The slanted edges 56 may each be about 2.85 inches long and the total height between the base edge 50 and the apex 60 may be about two inches.

In operation of the tool 10, the long wedge shaped foot plate 28 may be extended under a floor board or roof board between rafters, beams or studs. The handle 12 will be upright or extending out perpendicular to the board being pried. The base plate 14 will rest on the underlying rafters or studs to act as a fulcrum. It will be understood that maximum leverage may be exerted in this way to pry a board up or out. The chamfered end 23 of the base plate 14 may be inserted under a shingle on a roof to pry it up. The other end of the base plate 14 will provide a fulcrum while the handle 12 exerts leverage. In both usages of the foot 28 and the base plate 14, it will not be necessary to strike them with a hammer as is required with a conventional crowbar to insert it into position for prying up a board or shingle. When the tool is used for prying, the rear anvil plate strengthens the joints between the handle 12 and the plates 14 and 28. In another use of the tool 10, it may be used as a sledge hammer. The anvil plate 40 may serve as a hammer had, with the outer or rear side 44 providing the striking surface. Alternatively, the base plate 14 cam serve as a hammer head with the edge 16 serving as the striking surface. When a wedge is required for any purpose such as splitting a board or brick, the tool 10, may be used in either of two ways. The sharp end 38 of the foot plate 28 may be the entering end of the wedge while the handle 12 is swung toward the article being split. Alternatively, the sharp end 23 of the plate 14 may be the entering end of the wedge while the handle 12 is swung toward the article being split. In similar fashion, the tool 10 may be used as a pick and a pickaxe. The massive thicknesses of the plates 14, 28, and 40 will withstand forces of any magnitude encountered in ordinary service for prying, hammering, wedging, and picking and other uses to which the tool 10 may be put.

It will be noted that the handle 12 is secured about midway between the opposite ends 16, 23 of the base plate 14 which is perpendicular to the longitudinal axis of the handle 12. Thus, the tool 10 can be disposed in a stable position, with the handle 12 upright and the base plate 14 resting on the bottom side 20.

It will also be noted that the anvil plate 40 or 40' has the lateral edge 56 or 56' converging upwardly from the long bottom edge 50 to the apical end 60 or 62. Since the anvil plate 40 is secured to both the base plate 24 and to the lower end of the handle 12, it reinforces the joint thereat as well as the handle 12 and the base plate 14.

The tool 10 can of course be made in other sizes and dimensions than those cited above as exemplary; and other angles than those indicated can be used for the corners and ends of the several plates. The entire tool is a strong, rigid structure, which will provide long, useful service under heavy duty work applications.

It should be understood that the foregoing relates to only a limited number of preferred embodiments of the invention which have been by way of example only and that it is intended to cover all the changes and modifications of the example of the invention herein chosen for the purpose of the disclosure, which do not constitute departures from the spirit and scope of the invention.

What is claimed is:

1. An improved lever bar adapted for performing multiple functions, comprising:

a relatively long, rigid handle bar having a straight longitudinal axis;

a generally rectangular, rigid, flat base plate having opposite parallel sides, one of said sides being secured by a rigid joint to one end of said bar in a plane perpendicular to said longitudinal axis thereof, said plate having spaced parallel lateral edges perpendicular to said parallel sides; and a thick flat foot plate having two long edges diverging from a sharp point to define an acute angle therebetween, said foot plate having a wide end opposite from said point said wide end being secured by another rigid joint to one side of said handle and to said one side of said base plate, said foot plate being disposed in an axial plane of said bar perpendicular to said base plate;

whereby said sharp point of said foot plate may be inserted behind a board to be pried away from spaced beams with said base plate resting on said beams and serving as a fulcrum while said handle serves as a lever.

2. An improved lever bar as defined in claim 1, wherein said handle bar is disposed about midway between opposite ends of said base plate, so that said base plate can support said bar in an upright position.

3. An improved lever bar as defined in claim 1, wherein said base plate has a chamfered end adapted to enter under a roof shingle for prying same away from said roof, while the other end of said base plate serves as a fulcrum for said handle.

4. An improved lever bar as defined in claim 3, wherein said other end of said base plate may serve as a hammer head, said base plate having a flat end edge opposite from said chamfered end to serve as a striking surface.

5. An improved lever bar as defined in claim 1, further comprising a massive flat anvil plate disposed at the other side of said handle, said anvil plate having two spaced, parallel sides, one of said sides of said anvil plate being secured by a further rigid joint to said other side of said handle and to one of said lateral edges of said base plate; whereby said anvil plate reinforces said handle at said one end thereof, when said foot plate is used to pry said board away from said beams.

6. An improved lever bar as defined in claim 5 wherein the other side of said anvil plate is flat to serve as a striking surface.

7. An improved lever bar as defined in claim 5, wherein said anvil plate is generally triangular in form with a long lower end secured to said base plate and an apical upper end secured to said handle to reinforce said handle.

8. An improved lever bar as defined in Claim 5, wherein said anvil plate is generally trapezoidal in form with a long lower end secured to said base plate and a short upper end disposed parallel to said lower end and secured to said handle to reinforce the same.

9. An improved lever bar as defined in claim 5, wherein said base plate has a chamfered end adapted to enter under a roof shingle for prying same away from said roof, while the other end of said base plate serves as a fulcrum for said handle.

10. An improved lever bar as defined in claim 9, wherein said handle bar is disposed about midway between opposite ends of said base plate so that said base plate can support said bar in an upright position.

11. An improved lever bar as defined in claim 10, wherein said other end of said base plate has a flat end edge opposite from said chamfered end to serve as a striking surface.

12. An improved lever bar as defined in claim 5, wherein said anvil plate has a long lower end rigidly secured to said base plate, said anvil plate having lateral edges converging upwardly from said lower end thereof to an apical end rigidly secured to said handle to reinforce the same.

13. An improved lever bar as defined in claim 1, wherein all of said rigid joints are formed by permanent, rigid welds.

* * * * *